US011268286B2

(12) United States Patent
Gu et al.

(10) Patent No.: US 11,268,286 B2
(45) Date of Patent: Mar. 8, 2022

(54) QUICKLY DISMANTLABLE FLOOR MEMBER AND SPLICED FLOOR

(71) Applicants: Haibing Gu, Shanghai (CN); Jiaojiao Liu, Yxing (CN); Min Zhong, Shanghai (CN)

(72) Inventors: Haibing Gu, Shanghai (CN); Chuanlong Sheng, Shanghai (CN); Min Zhong, Shanghai (CN)

(73) Assignee: Jiangsu Longing New Materials Technology Co., Ltd., Yixing (CN)

( * ) Notice: Subject to any disclaimer, the term of this patent is extended or adjusted under 35 U.S.C. 154(b) by 0 days.

(21) Appl. No.: 16/818,686

(22) Filed: Mar. 13, 2020

(65) Prior Publication Data

US 2020/0299972 A1 Sep. 24, 2020

(30) Foreign Application Priority Data

Mar. 19, 2019 (CN) ..... 201910209535.2

(51) Int. Cl.
*E04F 15/02* (2006.01)

(52) U.S. Cl.
CPC *E04F 15/02022* (2013.01); *E04F 2201/0505* (2013.01); *E04F 2201/096* (2013.01)

(58) Field of Classification Search
CPC ..... E04F 15/02; E04F 15/02022; E04F 15/02038; E04F 2201/00; E04F 2201/0505; E04F 2201/096
See application file for complete search history.

(56) References Cited

U.S. PATENT DOCUMENTS 4,988,131 A * 1/1991 Wilson ..... E04F 15/02 292/193
5,022,200 A * 6/1991 Wilson ..... E04F 15/02 52/127.9
6,077,011 A * 6/2000 Walker ..... F16B 21/165 24/453

(Continued)

FOREIGN PATENT DOCUMENTS

CN 2525156 Y 12/2002
CN 201495739 U 6/2010

(Continued)

OTHER PUBLICATIONS

Chinese Office Action dated Jul. 3, 2020 from corresponding Chinese Patent Application No. 201910209535.2, 15 pages.

*Primary Examiner* — James M Ference
(74) *Attorney, Agent, or Firm* — Ohlandt, Greeley, Ruggiero & Perle, L.L.P.

(57) ABSTRACT

The present disclosure discloses a quickly dismantlable floor member and a spliced floor, to solve the technical problem that the conventional floor members cannot be dismantled conveniently for repairing and replacement. The quickly dismantlable floor member is of a tetragon shape, a lateral face of a first side of the quickly dismantlable floor member is provided with an automatic latch, the automatic latch comprises a locking head, the locking head is retractable, and the locking head is able to, after the quickly dismantlable floor member is installed, join with an neighboring conventional floor member. The spliced floor employs three or more quickly dismantlable floor members.

17 Claims, 6 Drawing Sheets

(56) References Cited

U.S. PATENT DOCUMENTS

| | | | | | |
|---|---|---|---|---|---|
| 6,128,881 | A * | 10/2000 | Bue | E04F 15/02 | 52/177 |
| 7,111,360 | B1 * | 9/2006 | Hsu | E05C 19/04 | 16/85 |
| 8,960,734 | B2 * | 2/2015 | Camp | E05B 17/0037 | 292/193 |
| 10,294,677 | B1 * | 5/2019 | Casey | E04F 15/02038 | |
| 2002/0067045 | A1 * | 6/2002 | Blanchard | F16B 19/109 | 292/252 |
| 2004/0112004 | A1 * | 6/2004 | Zawinsky | E04F 13/0846 | 52/749.1 |
| 2007/0069526 | A1 * | 3/2007 | Hsu | E05C 19/04 | 292/252 |
| 2015/0027079 | A1 * | 1/2015 | Pantev | E04F 13/0889 | 52/582.2 |
| 2016/0153202 | A1 * | 6/2016 | Matchung | E01C 9/086 | 52/220.2 |
| 2020/0299972 | A1 * | 9/2020 | Gu | E04F 15/02038 | |

FOREIGN PATENT DOCUMENTS

| | | | | |
|---|---|---|---|---|
| CN | 201546414 | U | | 8/2010 |
| CN | 203429965 | U | | 2/2014 |
| CN | 207776357 | U | | 8/2018 |
| CN | 108643506 | A | * | 10/2018 |
| CN | 108729622 | A | | 11/2018 |
| CN | 108824751 | A | * | 11/2018 |
| CN | 108824751 | A | | 11/2018 |
| CN | 109339389 | A | | 2/2019 |
| CN | 109537845 | A | * | 3/2019 |
| DE | 20 2010 018 028 | U1 | | 11/2013 |

* cited by examiner

QUICKLY DISMANTLABLE FLOOR MEMBER AND SPLICED FLOOR

CROSS REFERENCE TO RELATED APPLICATION

This application claims the benefit under 35 U.S.C. § 119(a) of Chinese Application No. 201910209535.2 filed Mar. 19, 2019 the contents of which are incorporated by reference herein in their entirety.

BACKGROUND OF THE DISCLOSURE

1. Field of the Disclosure

The present disclosure relates to the field of floors, and particularly relates to a quickly dismantlable floor member. The present disclosure further relates to a spliced floor.

2. Description of the Related Art

Commonly used floor members include flat lock type and latch type, and the floor members are joined according to the principle of mortise-and-tenon structure, and are provided with male buckles and female buckles. Taking a rectangular floor member as an example, two of the four sides are provided with a male buckle, and the other two sides are provided with a female buckle. The male buckles and female buckles of neighboring floor members clip to realize the joining among a plurality of floor members, to form an integral ground, and the floor members have close connection, and cannot be easily separated even by stamping.

However, in certain cases floor members would be damaged; for example, the falling of a heavy thing smashes a floor member, the falling of a sharp object breaks a floor member, high temperature or a burning object scalds a floor member, oil paint contaminates a floor member, and so on. However, usually merely one or several floor members are damaged, in which case the dismantling and replacement of the damaged floor member are very inconvenient. That is because all of the floor members clip and join together, are very difficult to be disconnected from the middle of a room, and are required to be dismantled from an edge of the room by removing the depression bars, and it is required to remove all of the furniture and articles from the room before the repairing, which has a big workload for dismantling and installation, and has a low degree of recovering.

Conventional latch-type floor members further have the following disadvantages:

High difficulty in material selection: not all of woods can be used as latch solid wood, and the texture structures of many woods are not suitable to bear a pulling force.

Strict requirements on installation: Being different from the installation mode of flat-lock floor members, the installation mode of latch floor members requires special techniques and processes, and has stricter requirements on the processing of sides and corners in installation.

High requirements on the production equipment: latch structure has high requirements on the production equipment and the types of the base materials, and general floor manufacturing equipments have difficulty in manufacturing latch-type floor members.

Relatively high price: although latch-type floor member products are popular with many consumers, they have relatively high prices, and thus cannot satisfy consumers of all consumption levels, and cannot be popularized.

SUMMARY

Aiming at the solving at least the aforementioned problems, an object of the present disclosure is to provide a quickly dismantlable floor member, which can be spliced with conventional floor members, and can be easily installed and dismantled, which facilitates the repairing and replacement of floor members.

Another object of the present disclosure is to provide a spliced floor, which employs three or more quickly dismantlable floor members as mentioned.

In order to realize the above objectives, the present disclosure employs the following technical solution:

an aspect of the present disclosure provides a quickly dismantlable floor member, the quickly dismantlable floor member being of a tetragon shape, wherein a lateral face of a first side of the quickly dismantlable floor member is provided with an automatic latch, the automatic latch comprises a locking head, the locking head is retractable, and the locking head is able to, after the quickly dismantlable floor member is installed, join with an neighbouring conventional floor member.

Optionally, a second side of the quickly dismantlable floor member is opposite to the first side, a female buckle is provided at a lateral face of at least the second side, and the female buckle is able to, after the quickly dismantlable floor member is installed, join with a neighbouring conventional floor member.

Optionally, the quickly dismantlable floor member is of a rectangular shape, and further comprises a third side and a fourth side, the first side and the second side are configured opposite and are both longer sides, and the third side and the fourth side are configured opposite and are both shorter sides; and a lateral face of the fourth side is also provided with a female buckle.

Optionally, the lateral face of the first side is provided with more than one automatic latch.

Optionally, the lateral face of the third side is provided with a hand clasp, and the hand clasp is of an inverse-step shape.

Optionally, the female buckle is of flat lock type or latch type.

Optionally, the automatic latch further comprises a positioning board and a spring, the positioning board is provided with a first through hole in the middle, a front end of the locking head is configured as ball head shape or slope shape, the front end of the locking head protrudes from the first through hole, the spring is provided at a rear end of the locking head, the locking head is provided with a radial flange thereon, a diameter of the flange is greater than a diameter of the first through hole, and a front end of the spring presses against the flange.

Optionally, the lateral face of the first side is provided with a first slot corresponding to the positioning board, and is provided with a second slot corresponding to the locking head, each of two ends of the positioning board is provided with a second through hole for mounting a screw, the positioning board is fixed within the first slot by mounting the screws, and the positioning board limits the locking head and the spring within the second slot.

Optionally, the automatic latch further comprises a lock body and a spring, the lock body is provided with a containing slot therein, the locking head is mounted in the containing slot, both of the locking head and the containing slot are of a T shape, a width of a front end of the locking head is less than a width of the rear end, the front end of the locking head protrudes from a front end of the containing slot, the front end of the locking head is configured as circular arc shape or slope shape, a rear end of the containing slot is provided with a backboard that seals the containing slot, the spring is provided at a rear end of the locking head, the front end of the spring presses against the locking head, and the rear end of the spring presses against the backboard.

Optionally, the lateral face of the first side is provided with a slot corresponding to the lock body, the lock body is provided with a through hole for mounting a screw, and the lock body is fixed within the slot by mounting the screw.

Optionally, the automatic latch further comprises a lock sleeve and a spring, the lock sleeve is provided with a containing slot therein, the locking head is mounted at a slot opening of the containing slot, the locking head is spherical, the slot opening of the containing slot contracts to limit the locking head in the containing slot, the front end of the spring presses against the locking head, and the rear end of the spring presses against a slot bottom of the containing slot.

Optionally, the lateral face of the first side is provided with a slot corresponding to the lock sleeve, and the lock sleeve is in close fit to the slot to be fixed in the slot.

Optionally, the automatic latch is made of stainless steel, copper or nylon.

Optionally, the quickly dismantlable floor member is a solid-wood floor member, a solid-wood composite floor member or a strengthened composite floor member.

Another aspect of the present disclosure provides a spliced floor, comprising a plurality of conventional floor members, and further comprising three or more quickly dismantlable floor members, the quickly dismantlable floor members are arranged successively in a straight line, with the automatic latches maintained at the same side, and are spliced with the conventional floor members.

Optionally, the conventional floor members are a flat lock type floor or a latch type floor.

The advantages and beneficial effects of the quickly dismantlable floor member of the present disclosure are as follows:

The present disclosure uses the locking head to replace the male buckle of traditional floors, during installation, the quickly dismantlable floor member is directly pressed down, under this press, the locking head automatically retracts into the automatic locking mechanism, and when the installation is in place, the locking head automatically pops out to lock the quickly dismantlable floor member; during dismantling, the locking head can also automatically retract, so that the quickly dismantlable floor member is very easy to be dismantled and installed.

Each room merely requires a number of three to five quickly dismantlable floor members, which are successively spliced in one or more positions and installed in the central part of the room, and the other part of the room employs conventional floor members. When a floor member at any position of the room is required to be replaced, by merely prying up the number of quickly dismantlable floor members, all of the other floor members can be dismantled, which saves the duration of replacing and the cost of installation, and facilitates recovering the original state of the floor.

Figure 1:
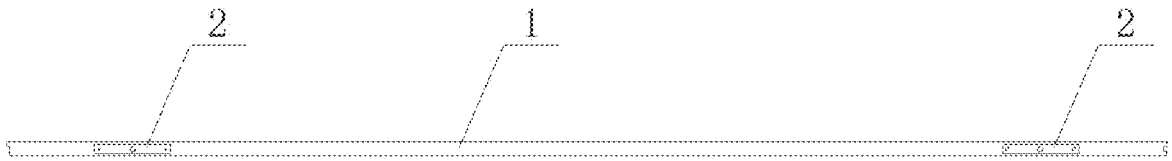
FIG. 1 is a front view of the quickly dismantlable floor member of the first embodiment of the present disclosure.

In the drawings the following reference numerals are provided: 1. quickly dismantlable floor member; 1-1. first female buckle; 1-2. second female buckle; 1-3. hand clasp; 1-4. first slot; 1-5. second slot; 1-6. threaded hole; 2. automatic latch; 2-1. locking head; 2-2. positioning board; 2-3. screw; 2-4. spring; 3. automatic latch; 3-1. lock body; 3-2. locking head; 3-3. fixing hole; 3-4. backboard; 3-5. spring; 4. conventional floor member; 5. automatic latch; 5-1. locking head; 5-2. spring; 5-3. lock sleeve.

DETAILED DESCRIPTION

The design concept of the present disclosure is described below. Aiming at the defect that the floor members in the prior art cannot be dismantled conveniently for repairing and replacement, the present disclosure provides a quickly dismantlable floor member, which uses the locking head to replace the male buckle of traditional floors, during installation, the quickly dismantlable floor member is directly pressed down, under this press, the locking head automatically retracts into the automatic locking mechanism, and when the installation is in place, the locking head automatically pops out to lock the quickly dismantlable floor member; during dismantling, the locking head can also automatically retract, so that the quickly dismantlable floor member is very easy to be dismantled and installed.

In order to make the objects, the technical solutions and the advantages of the present disclosure clearer, the embodiments of the present disclosure will be described hereinafter in further details in conjunction with the drawings.

The First Embodiment

Figure 2:
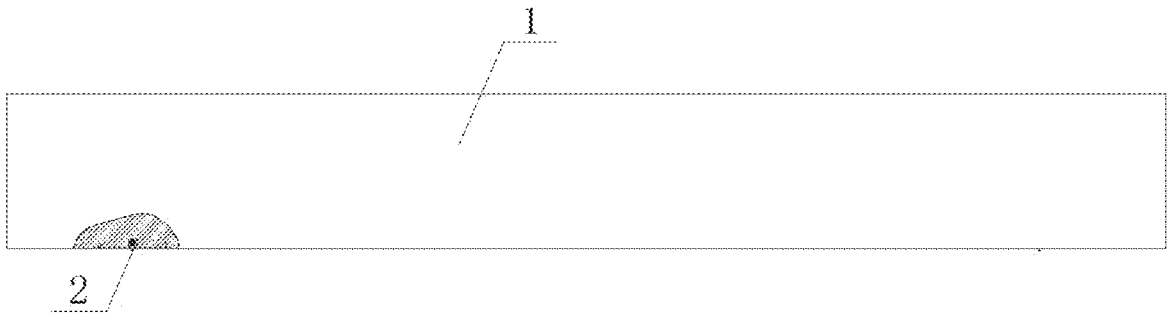
FIG. 2 is a top view of the quickly dismantlable floor member of the first embodiment of the present disclosure.
Figure 7:
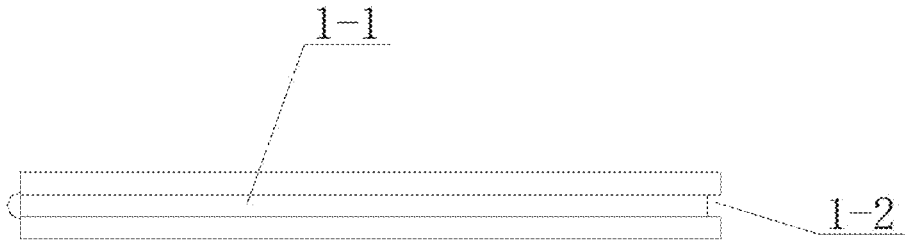
FIG. 7 is a right view of the quickly dismantlable floor member of the first embodiment of the present disclosure.
Figure 8:
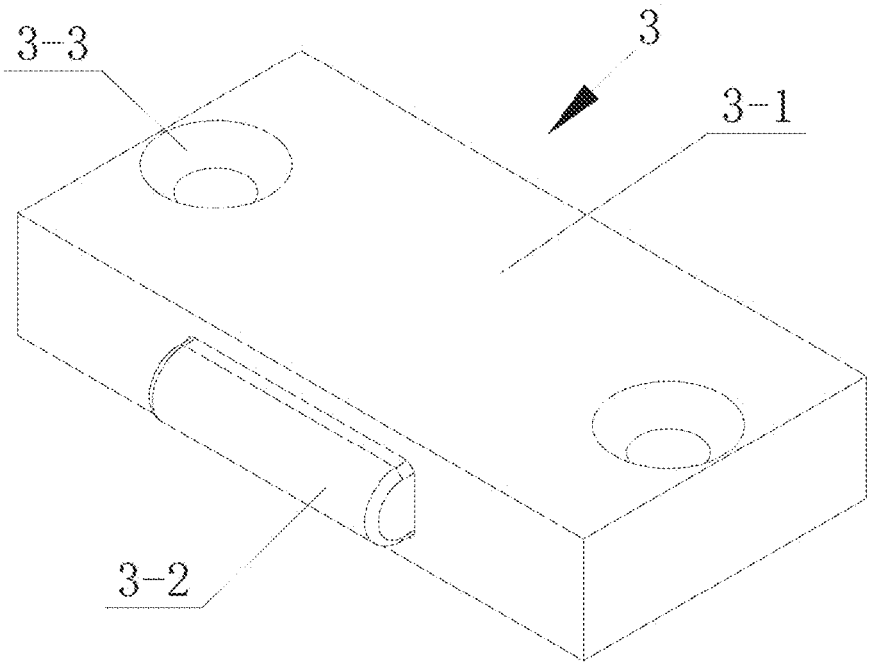
FIG. 8 is a perspective view of the automatic latch employed by the quickly dismantlable floor member of the second embodiment of the present disclosure.
Figure 9:
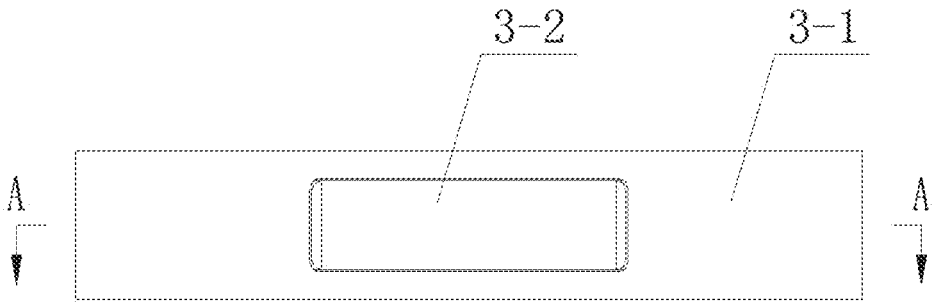
FIG. 9 is a front view of the automatic latch employed by the quickly dismantlable floor member of the second embodiment of the present disclosure.

FIGS. 1, 2 and 7 show the first embodiment of the present disclosure. The present embodiment provides a quickly dismantlable floor member 1. In the drawings, the quickly dismantlable floor member 1 is a common rectangle, which has four sides. The first side and the second side are configured opposite and are both longer sides. The third side and the fourth side are configured opposite and are both shorter sides.

The lateral face of the first side of the quickly dismantlable floor member 1 is provided with two automatic latches 2, each of which comprises a locking head 2-1. In the processes of the dismantling and installation of the quickly dismantlable floor member 1, the locking head 2-1 is retractable. When the quickly dismantlable floor member 1 is spliced with conventional floor members, the locking head 2-1 is joined with a neighboring conventional floor member. The corresponding side of the neighboring conventional floor member is required to be provided with a female buckle, and the locking head 2-1 protrudes into the female buckle to realize the joining.

The corresponding side of the neighboring conventional floor member may also be specially provided with a slot that cooperates with the locking head 2-1, so that the joining between the quickly dismantlable floor member 1 and the conventional floor member is more stable.

In order that the quickly dismantlable floor member 1 maintains a fastness state in use, and can sustain stamping for a long time, a female buckle 1-2 may be provided at the lateral face of at least the second side. When the quickly dismantlable floor member 1 is spliced with conventional floor members, the female buckle 1-2 is joined with the neighboring conventional floor member, and the corresponding side of the neighboring conventional floor member is required to be provided with a male buckle. The female buckle is of a concave type, which does not enlarge the size of the quickly dismantlable floor member 1, and facilitates the dismantling and installation of the quickly dismantlable floor member 1.

Figure 5:
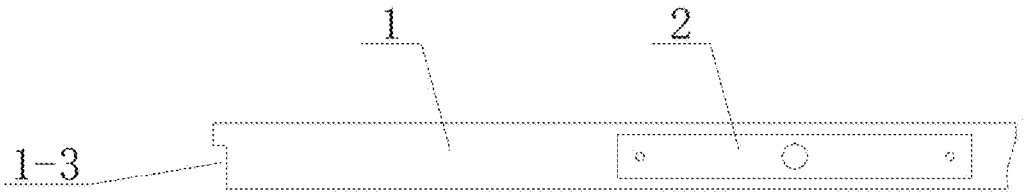
FIG. 5 is a left enlarged view of the quickly dismantlable floor member in FIG. 1.
Figure 6:
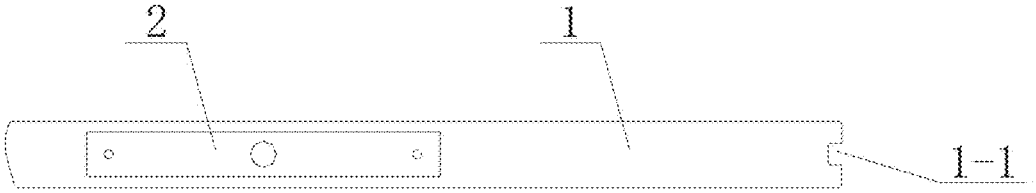
FIG. 6 is a right enlarged view of the quickly dismantlable floor member in FIG. 1.

As shown in FIG. 5, the lateral face of the third side, which is next to the first side, is provided with a hand clasp 1-3, and the hand clasp 1-3 is of an inverse-step shape. During the dismantling of the quickly dismantlable floor member 1, the top surface of the quickly dismantlable floor member 1 may be sucked with a small-size vacuum suction cup. The vacuum suction cup is positioned adjacent to the first side, and applying an upward pulling force causes the first side of the quickly dismantlable floor member 1 to incline upwardly, with the locking head 2-1 of the automatic latch 2 retracts under a press. At this point, a force may be applied at the hand clasp 1-3 to help pry up the quickly dismantlable floor member 1.

In the present embodiment, as shown in FIG. 7, the lateral face of the fourth side is also provided with a female buckle 1-1. When the quickly dismantlable floor member 1 is spliced with conventional floor members, the female buckle 1-1 may also be joined with the neighboring conventional floor member, and the corresponding side of the neighboring conventional floor member is required to be provided with a male buckle.

The female buckles 1-1, 1-2 are of flat lock type, and correspondingly, the conventional floor members spliced with the quickly dismantlable floor member 1 are also floors of flat lock type.

The female buckles 1-1, 1-2 may also be designed as latch type, and correspondingly, the conventional floor members spliced with the quickly dismantlable floor member 1 are also floors of latch type.

If the length of the first side is relatively large, the lateral face of the first side may also be provided with more than two automatic latches 2, for example three or four, which may be determined according to the actual product.

As shown in FIG. 5, the hand clasp 1-3 may be machined and shaped on the quickly dismantlable floor member 1 by means of milling. When the quickly dismantlable floor member 1 is spliced with conventional floor members, the outer sides of the hand clasps 1-3 also closely contact with the conventional floor members, which does not leave a too wide gap.

Figure 3:
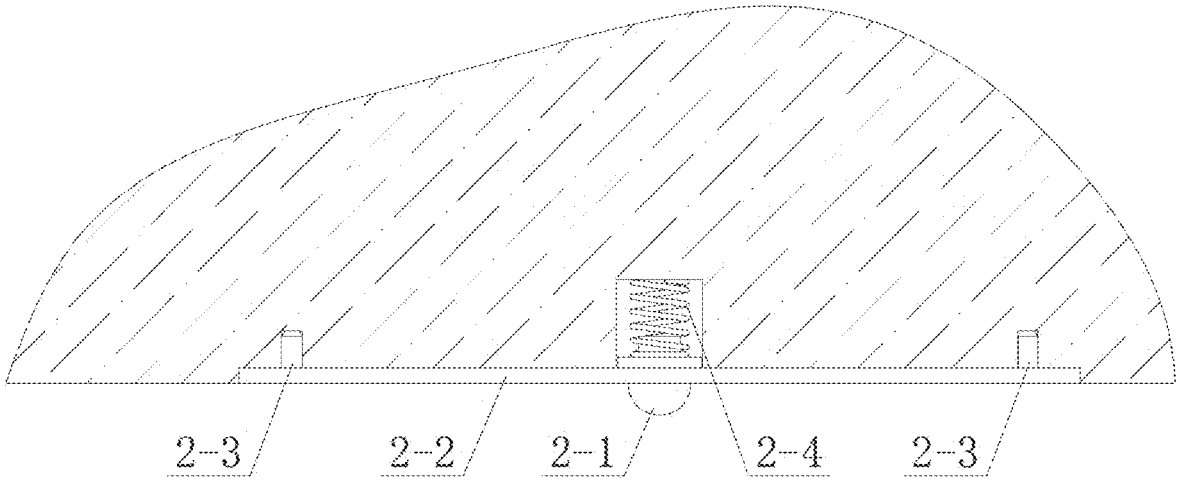
FIG. 3 is a partial enlarged view of the quickly dismantlable floor member in FIG. 2.

The detailed structure of the automatic latch 2 is as shown in FIG. 3. The automatic latch 2 further comprises a positioning board 2-2 and a spring 2-4. The positioning board 2-2 is provided with a first through hole in the middle. The front end of the locking head 2-1 is configured as ball head shape or slope shape, and the front end of the locking head 2-1 protrudes from the first through hole. The spring 2-4 is provided at the rear end of the locking head 2-1. The locking head 2-1 is provided with a radial flange. The diameter of the flange is greater than the diameter of the first through hole. The front end of the spring 2-4 pushes the flange.

Under an external press, the locking head 2-1 can retract into the automatic latch 2, and after the external press is removed, under the effect of the elastic restoration force by the spring 2-4, the front end of the locking head 2-1 protrudes again from the first through hole of the positioning board 2-2.

The front end of the locking head 2-1 is configured as ball head shape or slope shape, which can facilitate the locking head 2-1 to move into and out of the female buckle of the neighboring floor. If the front end of the locking head 2-1 is configured as a slope shape, it is required to comprise at least two symmetrical, upper and lower slopes.

Figure 4:
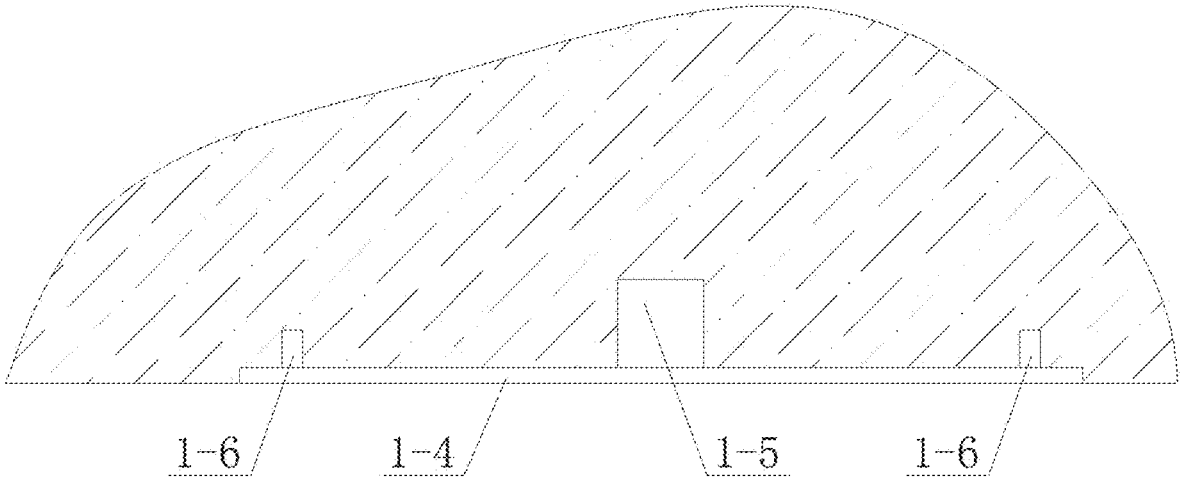
FIG. 4 is a top view of the automatic latch mounting slot provided at the quickly dismantlable floor member of the first embodiment of the present disclosure.

To mount the automatic latch 2, as shown in FIG. 4, the lateral face of the first side of the quickly dismantlable floor member 1 is provided with a first slot 1-4 corresponding to the positioning board 2-2, and is provided with a second slot 1-5 corresponding to the locking head 2-1, the slot opening of the second slot 1-5 is located at the central position of the bottom of the first slot 1-4, each of the two ends of the positioning board 2-2 is provided with a second through hole for mounting a screw 2-3, the positioning board 2-2 is fixed in the first slot 1-4 by mounting the screw 2-3, wherein in this embodiment the axial direction of the screw 2-3 and the width direction of the quickly dismantlable floor member 1 are the same, correspondingly the first slot 1-4 is provided with a threaded hole 1-6 therein, and the positioning board 2-2 limits the locking head 2-1 and the spring 2-4 in the second slot 1-5.

The first slot 1-4 and the second slot 1-5 may be machined and shaped on the blank of the floor member by means of milling.

The locking head 2-1 is blocked by the flange, so it does not fall from the first through hole of the positioning board 2-2, and can stay in the second slot 1-5.

Preferably, the through holes at the two ends of the positioning board 2-2 may be designed as counterbores, so that after the screws 2-3 are mounted, the nuts of the screws 2-3 do not project from the positioning board 2-2, and the outer side face of the positioning board 2-2 flushes with the lateral face of the first side.

The automatic latch 2 in this embodiment may be made of stainless steel, copper or nylon, which are not easily corrosible, and may also employ other types of suitable materials.

The quickly dismantlable floor member 1 may be a solid-wood floor member, a solid-wood composite floor member or a strengthened composite floor member, which are also suitable for the conventional floor members.

The quickly dismantlable floor member 1 of this embodiment may also be a square, with the lengths of the four sides equal, and all of the modes of configuring the automatic latches 2 and the hand clasps 1-3 can refer to the rectangular quickly dismantlable floor member 1, which is not described repeatedly here.

The quickly dismantlable floor member of this embodiment uses the locking head to replace the male buckle of traditional floors, during installation, the quickly dismantlable floor member is directly pressed down, the locking head under the force automatically retracts into the automatic latch mechanism; and when the installation is in place, the locking head automatically protrudes to lock the quickly dismantlable floor member; during dismantling, the locking head can also automatically retract, so that the quickly dismantlable floor member is very easy to be dismantled and installed.

The quickly dismantlable floor member of this embodiment does not have a high requirement on the production equipment, which saves energy and reduces emission. Furthermore, it has a low cost, and can satisfy the demand of consumers.

The Second Embodiment

This embodiment is different from the first embodiment in that, as shown in FIGS. 8, 9, 10, 11 and 12, the quickly dismantlable floor member 1 employs an automatic latch 3 of a structure different from that of the automatic latch 2, the automatic latch 3 comprises a locking head 3-2, and further comprises a lock body 3-1 and two springs 3-5.

The lock body 3-1 is provided with a containing slot therein, the locking head 3-2 is mounted in the containing slot, and both of the locking head 3-2 and the containing slot are of a T shape. The width of the front end of the locking head 3-2 is less than the width of the rear end. The front end of the locking head 3-2 protrudes from the front end of the containing slot. The T-shaped structure can limit the locking head 3-2 in the containing slot.

The front end of the locking head 3-2 is configured as circular arc shape or slope shape, the rear end of the containing slot is provided with a backboard 3-4 that seals the containing slot, the spring 3-5 is provided at the rear end of the locking head 3-2, the front end of the spring 3-5 presses against the locking head 3-2, and the rear end of the spring 3-5 presses against the backboard 3-4, so that the locking head 3-2 has a retracting function.

To mount the automatic latch 3, the lateral face of the first side of the quickly dismantlable floor member 1 is provided with a slot corresponding to the lock body 3-1, wherein the slot may be machined upwardly from the bottom face of the blank of the floor member, and its volume matches with the lock body 3-1. The lock body 3-1 is provided with through holes 3-3 for mounting screws, and the lock body 3-1 is fixed within the slot by mounting the screws, wherein in this embodiment the axial direction of the screws and the thickness direction of the quickly dismantlable floor member 1 are the same.

Preferably, the through holes 3-3 are designed as a counterbore, the nuts of the screws do not project from the lock body 3-1, and the bottom face of the lock body 3-1 flushes with the bottom face of the quickly dismantlable floor member 1.

Figure 10:
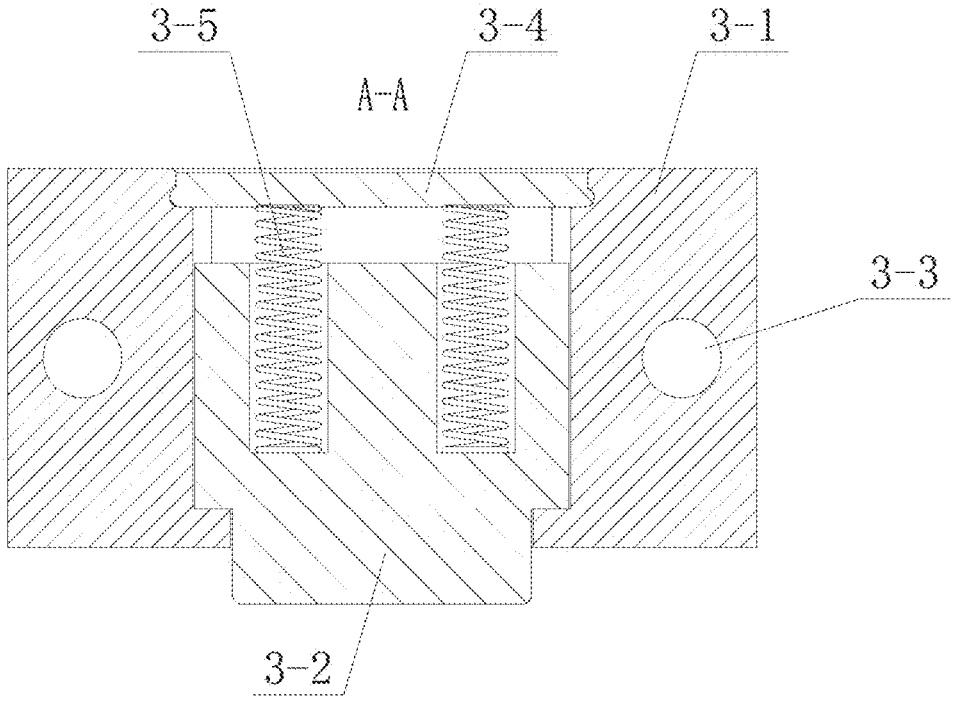
FIG. 10 is a sectional view taken along the line A-A in FIG. 9.
Figure 11:
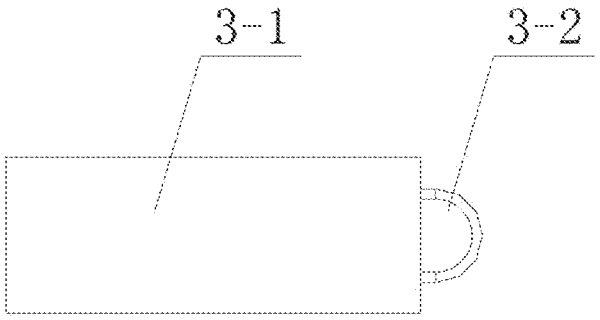
FIG. 11 is a left view of the automatic latch employed by the quickly dismantlable floor member of the second embodiment of the present disclosure.
Figure 12:
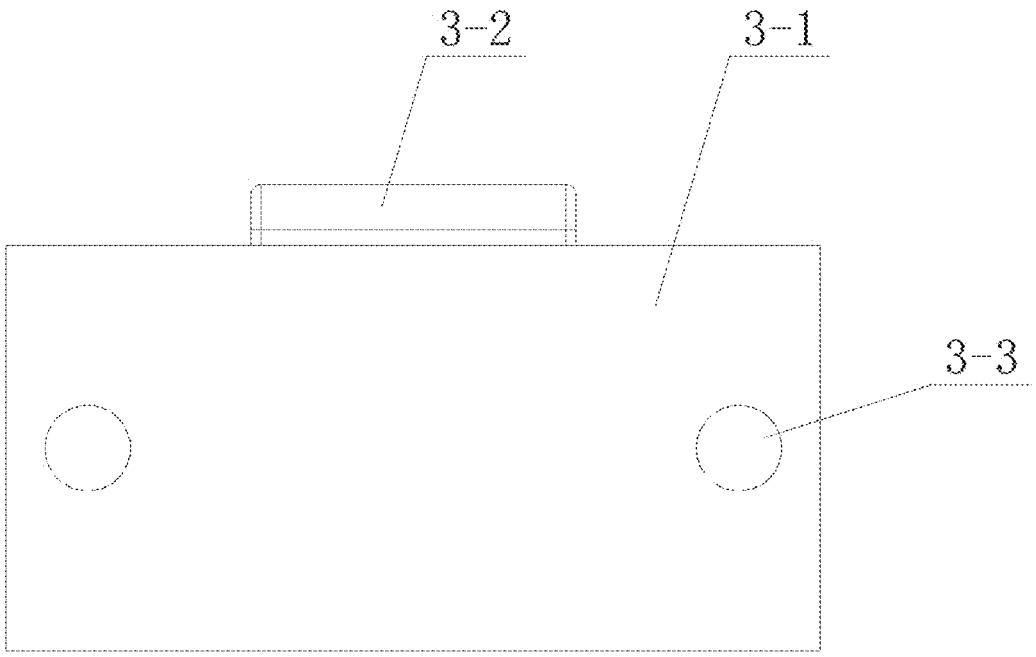
FIG. 12 is a bottom view of the automatic latch employed by the quickly dismantlable floor member of the second embodiment of the present disclosure.

In order to combine with the springs 3-5, the rear end of the locking head 3-2 may be provided with a slot or a convex column. As shown in FIG. 10, the locking head 3-2 is provided with a slot at the rear end, to limit the springs 3-5.

The width of the locking head 3-2 of this embodiment is relatively large, so that the joining between the quickly dismantlable floor member 1 and the neighboring floor is more stable and has a higher strength. The lock body 3-1, the locking head 3-2 and the springs 3-5 in the automatic latch 3 may be preassembled, to have a good integrality, to be mounted on the quickly dismantlable floor member 1 more easily.

The structures of the other parts of quickly dismantlable floor member 1 of this embodiment are the same as those of the first embodiment, which will not be described repeatedly here.

The Third Embodiment

Figure 13:
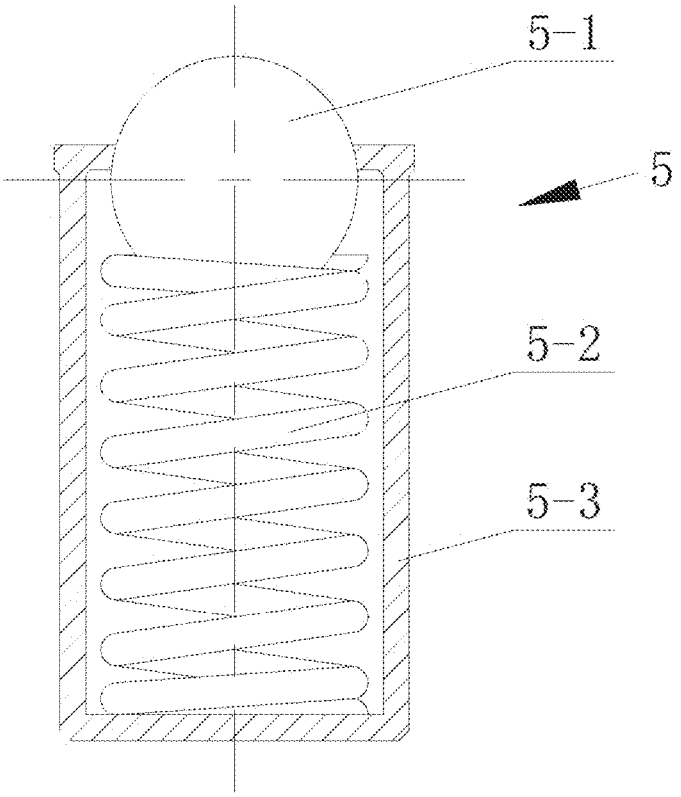
FIG. 13 is a sectional view of the automatic latch employed by the quickly dismantlable floor member of the third embodiment of the present disclosure.

This embodiment is different from the first embodiment in that, as shown in FIG. 13, the quickly dismantlable floor member 1 employs an automatic latch 5 of a different structure, wherein the automatic latch 5 comprises a locking head 5-1, and further comprises a lock sleeve 5-3 and a spring 5-2.

The lock sleeve 5-3 is provided with a containing slot therein, the locking head 5-1 is mounted at the slot opening of the containing slot, the locking head 5-1 is spherical, the slot opening of the containing slot retracts to limit the locking head 5-1 in the containing slot, the front end of the spring 5-2 presses against the locking head 5-1, and the rear end of the spring 5-2 presses against the slot bottom of the containing slot, so that the locking head 5-1 has a retracting function.

Preferably, the lock sleeve 5-3 is cylindrical, and the bottom end of the lock sleeve is closed. The diameter of the containing slot should be slightly greater than the diameters of the locking head 5-1 and the spring 5-2, respectively.

The automatic latch 5, the locking head 5-1, the lock sleeve 5-3 and the spring 5-2 of this embodiment may be preassembled, by placing the spring 5-2 and the locking head 5-1 sequentially into the lock sleeve 5-3, and then contracting the slot opening, wherein the diameter of the slot opening after the contracting should be slightly less than the diameter of the locking head 5-1, and the locking head 5-1 does not disengage from the containing slot, to complete the assembling of the automatic latch 5. The automatic latch 5 so manufactured has a good integrality, to be mounted on the quickly dismantlable floor member 1 more easily.

To mount the automatic latch 5, the lateral face of the first side of the quickly dismantlable floor member 1 is provided with a slot corresponding to the lock sleeve 5-3, the diameter of the slot is slightly less than the diameter of the lock sleeve 5-3, and the lock sleeve 5-3 is in close fit to the slot to be fixed in the slot, whereby the screws for fastening are not required, and the installation becomes simple. Because the automatic latch 5 bears the pressing force in the usage process, it cannot easily disengage from the slot.

The structures of the other parts of quickly dismantlable floor member 1 of this embodiment are the same as those of the first embodiment, which will not be described repeatedly here.

The Fourth Embodiment

Figure 14:
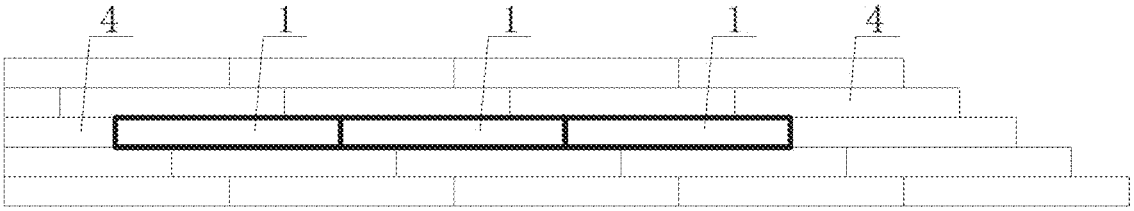
FIG. 14 is a diagram of the operating state of the quickly dismantlable floor member of the fourth embodiment of the present disclosure.

This embodiment provides a spliced floor, as shown in FIG. 14, comprising three quickly dismantlable floor members 1 of the first embodiment, the second embodiment or the third embodiment, wherein the quickly dismantlable floor members 1 are arranged successively in a straight line, and the automatic latches are arranged at the same side, and are spliced with the conventional floor members 4.

By providing the three quickly dismantlable floor members 1, when all of the quickly dismantlable floor members 1 have been pried up, a space sufficient for dismantling the conventional floor members 4 can be left.

Among them, each of the leftmost and the middle quickly dismantlable floor members 1 has two sides that are joined with the neighboring conventional floor members 4, which are the first sides and the second sides, and the rightmost quickly dismantlable floor member 1 has three sides that are joined with the neighboring conventional floor members 4, which are the first side, the second side and the fourth side.

The dismantling of the quickly dismantlable floor member 1 may start from the leftmost quickly dismantlable floor member 1 in FIG. 14. The top surface of the quickly dismantlable floor member 1 is sucked with a small-size vacuum suction cup, the vacuum suction cup is positioned adjacent to the first side, and applying an upward pulling force causes the first side of the quickly dismantlable floor member 1 to incline upwardly, with the locking head of the automatic latch retracting under a press. Accordingly, the leftmost quickly dismantlable floor member 1 can be pried up, during the process of prying, a force may be applied at the hand clasp to help pry up the quickly dismantlable floor member 1, then the middle quickly dismantlable floor member 1 and the rightmost quickly dismantlable floor member 1 are sequentially pried up, and then the conventional floor members 4 can be dismantled.

The dismantling may also start from the middle quickly dismantlable floor member 1, and then the leftmost quickly dismantlable floor member 1 and the rightmost quickly dismantlable floor member 1 are dismantled gradually.

The conventional floor members 4 may be flat lock type floors or latch type floors.

Each room merely requires a number of three or more, for example, three to five, quickly dismantlable floor members, which are successively spliced and installed in the central part of the room, and the other part of the room employs conventional floor members. When a conventional floor member at any position of the room is required to be replaced, by merely prying up the number of quickly dismantlable floor members, all of the conventional floor members can be dismantled. The dismantling and repairing processes do not require to move the furniture and articles in the room to a large extent, which saves the duration of replacing and the cost of installation, and facilitates recovering the original state of the floor.

If the area of a room is relatively large, the room may be provided with the quickly dismantlable floor member at two or more positions alternatively. At each of the positions, a number of three or more, for example, three to five, quickly dismantlable floor members, are provided, and the other parts of the room employs conventional floor members. If a conventional floor member in the room is required to be replaced, by merely prying up the number of adjacent quickly dismantlable floor members, all of the rest of conventional floor members can be dismantled.

The structure of the quickly dismantlable floor member of this embodiment is the same as that of the first embodiment or the second embodiment, which will not be described repeatedly here.

The above are only particular embodiments of the present disclosure. However, the protection scope of the present disclosure is not limited thereto. Any variation or substitution that a person skilled in the art can easily envisage within the scope of the technique disclosed by the present disclosure should fall within the protection scope of the present disclosure. Therefore, the protection scope of the present disclosure should be subject to the protection scope of the claims.

What is claimed is:

1. A dismantlable floor member comprising:

a lateral face of a first side of the dismantlable floor member that is provided with an automatic latch;

wherein the dismantlable floor member is of a tetragon shape;

wherein the automatic latch further comprises a locking head; and wherein the locking head is retractable, and the locking head is able to join with a neighboring dismantlable floor member that does not have the automatic latch after the dismantlable floor member is installed;

wherein the automatic latch further comprises a lock sleeve and one spring;

wherein the lock sleeve is provided with a containing slot therein, and the locking head is mounted at a slot opening of the containing slot;

wherein the locking head is spherical, and the slot opening of the containing slot contracts to limit the locking head in the containing slot; and wherein the spring has a front end that presses against the locking head, and a rear end of the spring presses against a slot bottom of the containing slot.

2. The dismantlable floor member according to claim 1, further comprising a second side of the dismantlable floor member;

wherein the second side is opposite to the first side; and a female buckle is provided at a lateral face of at least the second side, and the female buckle is able to join with a different neighboring dismantlable floor member after the dismantlable floor member is installed.

3. The dismantlable floor member according to claim 2, wherein the dismantlable floor member is of a rectangular shape, and further comprises a third side and a fourth side;

wherein the first side and the second side are configured opposite to each other and are both longer sides of the rectangular shape; and wherein the third side and the fourth side are configured opposite to each other and are both shorter sides of the rectangular shape; and a lateral face of the fourth side is provided with a female buckle.

4. The dismantlable floor member according to claim 3, wherein the automatic latch is a plurality of automatic latches.

5. The dismantlable floor member according to claim 3, wherein the third side has a lateral face, and is provided with a hand clasp; and wherein the hand clasp is of an inverse-step shape.

6. The dismantlable floor member according to claim 3, wherein the female buckle is of a flat lock type or a latch type.

7. The dismantlable floor member according to claim 1, wherein the lateral face of the first side is provided with a slot corresponding to the lock sleeve, and wherein the lock sleeve is fixed in the slot.

8. The dismantlable floor member according to claim 1, wherein the lock sleeve is cylindrical, a bottom end of the lock sleeve is closed, and a diameter of the containing slot is greater than a diameter of the locking head and a diameter of the spring, respectively.

9. The dismantlable floor member according to claim 1, wherein the automatic latch is made of a material selected from the group consisting of stainless steel, copper, and nylon.

10. The dismantlable floor member according to claim 1, wherein the dismantlable floor member is a made of a material selected from the group consisting of solid-wood, solid-wood composite and strengthened composite.

11. The dismantlable floor member according to claim 1, wherein the dismantlable floor member is of a square shape.

12. A spliced floor, comprising at least three dismantlable floor members according to claim 1, and a plurality of neighboring dismantlable floor members;

wherein the automatic latch is a plurality of automatic latches; and wherein the at least three dismantlable floor members are arranged successively in a straight line, with the plurality of automatic latches maintained at the lateral face of the first side and are spliced with the plurality of neighboring dismantlable floor members.

13. The spliced floor according to claim 12, wherein the plurality of neighboring dismantlable floor members are a flat lock type floor member or a latch type floor member.

14. A dismantlable floor member comprising:

a lateral face of a first side of the dismantlable floor member that is provided with an automatic latch;

wherein the dismantlable floor member is of a tetragon shape;

wherein the automatic latch further comprises a locking head; and wherein the locking head is retractable, and the locking head is able to loin with a neighboring dismantlable floor member that does not have the automatic latch after the dismantlable floor member is installed;

wherein the automatic latch further comprises a positioning board and a spring;

wherein the positioning board is provided with a first through hole in a middle portion thereof;

wherein the locking head has a front end that is configured as a ball head shape or a slope shape;

wherein the front end of the locking head protrudes from the first through hole, the spring is provided at a rear end of the locking head, and the locking head is provided with a radial flange;

wherein the radial flange has a diameter that is greater than a diameter of the first through hole; and wherein the spring has a front end that presses against the radial flange;

wherein the lateral face of the first side is provided with a first slot corresponding to the positioning board, and is provided with a second slot corresponding to the locking head;

wherein the positioning board has two ends, that are each provided with a through hole for mounting a screw; and wherein the positioning board is fixed within the first slot by mounting the screws through the through hole at each end of the positioning board; and wherein the positioning board limits the locking head and the spring within the second slot.

15. A dismantlable floor member comprising:

a lateral face of a first side of the dismantlable floor member that is provided with an automatic latch;

wherein the dismantlable floor member is of a tetragon shape;

wherein the automatic latch further comprises a locking head; and wherein the locking head is retractable, and the locking head is able to loin with a neighboring dismantlable floor member that does not have the automatic latch after the dismantlable floor member is installed;

wherein the automatic latch further comprises a lock body and a spring, and the lock body is provided with a containing slot therein;

wherein the locking head is mounted in the containing slot, and both of the locking head and the containing slot are of a T shape;

wherein the locking head has a front end with a width that is less than a width of a rear end of the locking head;

wherein the front end of the locking head protrudes from a front end of the containing slot, and the front end of the locking head is configured as a circular arc shape or a slope shape; wherein the containing slot has a rear end that is provided with a backboard that seals the containing slot, and the spring is provided at a rear end of the locking head; and wherein the spring has a front end that presses against the locking head, and a rear end of the spring presses against the backboard;

wherein the lateral face of the first side is provided with a slot corresponding to the lock body, the lock body is provided with a through hole for mounting a screw, and the lock body is fixed within the slot by mounting the screw.

16. The dismantlable floor member according to claim 15, wherein the spring comprises two springs.

17. The dismantlable floor member according to claim 15, wherein the rear end of the locking head is provided with a slot or a convex column that cooperates with the spring.

* * * * *